US012326142B2

(12) United States Patent
Hembree et al.

(10) Patent No.: US 12,326,142 B2
(45) Date of Patent: Jun. 10, 2025

(54) DIAPHRAGM POSITION CONTROL SYSTEM

(71) Applicant: Wanner Engineering, Inc., Minneapolis, MN (US)

(72) Inventors: Richard Hembree, Port Coquitlam (CA); Dustin Featherstone, Hastings, MN (US); Scott C. Losey, Edina, MN (US)

(73) Assignee: Wanner Engineering, Inc., Minneapolis, MN (US)

( * ) Notice: Subject to any disclaimer, the term of this patent is extended or adjusted under 35 U.S.C. 154(b) by 252 days.

(21) Appl. No.: 18/146,744

(22) Filed: Dec. 27, 2022

(65) Prior Publication Data

US 2023/0304487 A1 Sep. 28, 2023

Related U.S. Application Data

(60) Provisional application No. 63/324,442, filed on Mar. 28, 2022.

(51) Int. Cl.
*F04B 43/067* (2006.01)
*F04B 23/04* (2006.01)
*F04B 43/00* (2006.01)

(52) U.S. Cl.
CPC ..... *F04B 43/067* (2013.01); *F04B 23/04* (2013.01); *F04B 43/0081* (2013.01); *F04B 2205/01* (2013.01); *F04B 2205/18* (2013.01)

(58) Field of Classification Search
CPC .... F04B 43/067; F04B 43/0081; F04B 23/04; F04B 2205/01; F04B 2205/18
See application file for complete search history.

(56) References Cited

U.S. PATENT DOCUMENTS 1,920,014 A 7/1933 Horton et al.
2,679,209 A 9/1949 Fischer et al.
(Continued)

FOREIGN PATENT DOCUMENTS

EP 1398504 3/2004
WO 9111616 8/1991
(Continued)

OTHER PUBLICATIONS

International Search Report and Written Opinion dated Aug. 11, 2006, 12 pages.
(Continued)

*Primary Examiner* — Charles G Freay
(74) *Attorney, Agent, or Firm* — Merchant & Gould P.C.

(57) ABSTRACT

A diaphragm pump system includes a diaphragm pump and a pressure regulator. The diaphragm pump has a housing having a pumping chamber containing fluid to be pumped, and a transfer chamber adapted to contain hydraulic fluid. A diaphragm is supported by the housing and at least partially defines a pumping chamber side and a transfer chamber side. A driven plunger slides in a reciprocating motion and forcing hydraulic fluid against the diaphragm. A first valve allows hydraulic fluid into the transfer chamber and a second valve allows hydraulic fluid to be removed from the transfer chamber. A hydraulic fluid reservoir is in fluid communication with the transfer chamber. The pressure regulator includes valving that provides a hydraulic fluid pressure above a pumped fluid inlet feed pressure to maintain a proper amount of hydraulic oil in the transfer chamber.

10 Claims, 6 Drawing Sheets

(56) References Cited

U.S. PATENT DOCUMENTS

| | | | | |
|---|---|---|---|---|
| 2,919,650 | A | 1/1960 | Wiggerman | |
| 3,769,879 | A | 11/1973 | Lonfquist, Jr. | |
| 3,814,548 | A * | 6/1974 | Rupp | F04B 43/073 417/470 |
| 3,884,598 | A | 5/1975 | Wanner | |
| RE29,055 | E * | 11/1976 | Wagner | F04B 43/067 417/388 |
| 4,050,859 | A | 9/1977 | Vork | |
| 4,381,180 | A | 4/1983 | Sell | |
| 4,416,599 | A | 11/1983 | De Longchamp | |
| 4,474,540 | A | 10/1984 | Bonastia et al. | |
| RE31,932 | E | 7/1985 | Christianson | |
| 4,749,342 | A | 6/1988 | Fritsch | |
| 4,865,528 | A | 9/1989 | Fritsch et al. | |
| 4,883,412 | A | 11/1989 | Malizard et al. | |
| 5,246,351 | A | 9/1993 | Horn et al. | |
| 5,326,234 | A | 7/1994 | Versaw et al. | |
| 5,667,368 | A | 9/1997 | Augustyn et al. | |
| 6,071,089 | A | 6/2000 | Maier et al. | |
| 6,343,614 | B1 | 2/2002 | Gray et al. | |
| 6,554,578 | B1 * | 4/2003 | Siegel | F04B 43/0081 417/383 |
| 6,899,530 | B2 | 5/2005 | Ehrke et al. | |
| 7,063,517 | B2 | 6/2006 | Towne et al. | |
| 7,090,474 | B2 | 8/2006 | Lehrke et al. | |
| 7,425,120 | B2 | 9/2008 | Hembree | |
| 7,654,801 | B2 | 2/2010 | Spude | |
| 7,665,974 | B2 * | 2/2010 | Hembree | F04B 43/067 417/387 |
| 2004/0228748 | A1 | 11/2004 | Lerhke et al. | |
| 2006/0239840 | A1 | 10/2006 | Hembree | |
| 2010/0014996 | A1 * | 1/2010 | Wilmsen | F04B 17/00 417/472 |

FOREIGN PATENT DOCUMENTS

| | | |
|---|---|---|
| WO | 9307389 | 4/1993 |
| WO | 2009157026 | 12/2009 |
| WO | 2019011385 | 1/2019 |
| WO | 2020161237 | 8/2020 |

OTHER PUBLICATIONS

International Search Report and Written Opinion dated Aug. 1, 2008, 15 pages.

International Search Report and Written Opinion dated Mar. 15, 2023, 23 pages.

* cited by examiner

DIAPHRAGM POSITION CONTROL SYSTEM

BACKGROUND OF THE INVENTION

Field of the Invention

The present invention is related to a diaphragm pump and in particular to a pump, such as diaphragm pump, with a system for maintaining a proper amount of hydraulic fluid in the pump.

Description of the Prior Art

Hydraulically driven diaphragm pumps are well known and used in a wide variety of applications. Such diaphragm pumps require a system for maintaining a correct volume of hydraulic fluid, usually oil, that transmits the displacement of a piston or plunger to the displacement of a diaphragm to impel pump driven fluid. In pumps where a plunger maintains pressure of the oil by a close clearance fit to a cylinder, there is a small loss of oil with each pressure stoke of the pump. Even when seals are used on a piston there is a certain amount of leakage that is expected. Also, during abnormal, blocked inlet conditions, it is possible for excess oil to be drawn in through control valving, or the cylinder leak paths. Therefore, there is a need to release volume from the driving fluid. To make up the volume of oil lost or added with each stroke there needs to be a system that can add or subtract oil from the driving fluid volume.

U.S. Pat. No. 7,425,120, DIAPHRAGM POSITION CONTROL FOR HYDRAULICALLY DRIVEN PUMPS, and U.S. Pat. No. 7,665,974, DIAPHRAGM PUMP POSITION CONTROL WITH OFFSET VALVE AXIS, both to Hembree and assigned to Wanner Engineering, Inc., describe valve systems that accomplish this volume control. However these pumps have limitations in certain operating situations. These systems draw replenishment fluid from an oil sump, usually the crankcase, that is at atmospheric pressure. Under pressure feed conditions, the amount of replenishment oil per stroke is limited because there is only a momentary drop in pressure below atmospheric, at the bottom of the stroke. If the volume of oil is insufficient, the diaphragm will not achieve a full stroke and the pump performance is diminished. On smaller pumps, the volumes are sufficiently small so that the fluid loss is acceptable. However, on larger pumps, the volume that needs to enter each stroke can be too large to occur in a momentary pulse at the bottom of the stroke.

Another common feature of existing systems is a spring that creates a bias pressure on the oil. An important function of this bias pressure is to assist in purging the air out of the oil zone when the pump is first primed. Without this bias spring, the diaphragm tends to be moved forward by the air, and therefore is not purged from the system.

It can therefore be appreciated that an improved pump and system is needed to supply hydraulic fluid to make up for losses. Such a system should be able to supply sufficient oil to make for losses even for large pumps that have pressure feed of the pumped fluid. Such a pump and system should be capable of replenishing fluid during the entire suction stroke regardless of the feed pressure of the pumped fluid. In addition, a system is needed that creates conditions to purge air out of the hydraulic chamber during priming, thus eliminating the need for a bias spring. The present invention addresses these problems, as well as others, associated with supplying hydraulic fluid in pumps.

SUMMARY OF THE INVENTION

The present invention is directed to a diaphragm pump system includes a diaphragm pump and a pressure regulator system to maintain a proper amount of hydraulic oil in the pump. The diaphragm pump has a housing having a pumping chamber containing fluid to be pumped, and a transfer chamber adapted to contain hydraulic fluid. A diaphragm is supported by the housing and at least partially defines a pumping chamber side and a transfer chamber side. A driven plunger slides in a reciprocating motion and forcing hydraulic fluid against the diaphragm. A first valve allows hydraulic fluid into the transfer chamber and a second valve allows hydraulic fluid to be removed from the transfer chamber. A hydraulic fluid reservoir is in fluid communication with the transfer chamber.

The pressure regulator includes valving that provides a hydraulic fluid pressure above a pumped fluid inlet feed pressure to maintain a proper amount of hydraulic oil in the transfer chamber. The valve assembly includes a combination of back pressure regulator, such as a spring loaded element, and remote pressure control valve.

The pressure regulator assembly has a diaphragm that controls a valve assembly. Fluid entering a valve port of the pump is on the controlled pressure side of the valve of the pressure regulator assembly. On the opposite side of the valve a drainage line leads to the sump. This is accomplished by a passage that communicates the pressure to one side of a diaphragm in the pressure regulator. A spring applies a force to the diaphragm that opposes the pressure. A further port is connected to the spring side of the pressure regulator diaphragm. The further port is connected to the feed pressure of the pump. In one embodiment, the spring is sized to apply a force to the pressure regulator assembly diaphragm that would require about 10-15 psi across the diaphragm to balance. The controlled pressure in valve port and chamber is therefore equal to the feed pressure plus 10 psi from the spring force. If the controlled pressure drops below the pressure above the diaphragm, the valve closes. This restricts the amount of oil from the oil pump, so pressure builds until the pressure regulator valve re-opens. A properly sized pressure regulator valve will maintain the correct amount of opening, so the controlled pressure is maintained.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings, wherein like reference letters and numerals indicate corresponding structure throughout the several views.

DETAILED DESCRIPTION OF THE PREFERRED EMBODIMENT(S)

Figure 1:
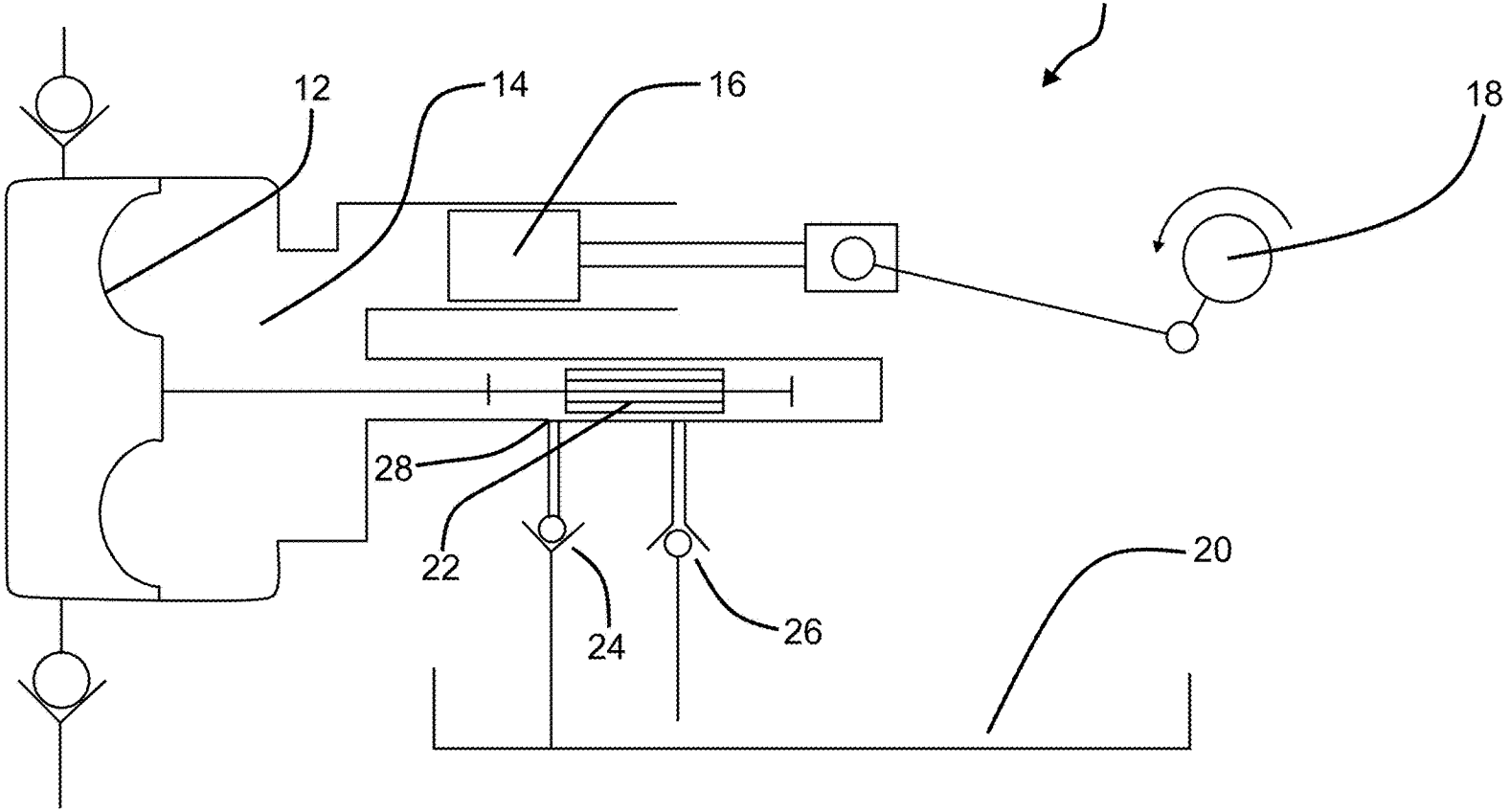
FIG. 1 PRIOR ART
FIG. 1 is a schematic diagram of a prior art diaphragm pump and oil control system.

Referring to FIG. 1, there is shown a schematic view of a pump (10) utilizing a diaphragm position control system such as described in U.S. Pat. No. 7,425,120. In this system a diaphragm (12) is driven by hydraulic fluid/oil in a transfer chamber (14). The hydraulic fluid is moved by a plunger or piston (16) that is driven by a crankshaft (108). That displacement of the piston (16) is transferred by the hydraulic fluid to cause displacement of the diaphragm (12). A supply of make-up oil is contained in a sump (20) as a fluid reservoir, which is usually the crankcase of the pump (10). In one embodiment, the make-up oil is a separate oil from the oil supply that is used to lubricate the crankshaft bearings and other moving parts of the pump (10). The oil sump (20) is normally at atmospheric pressure. A system using a valve spool (22) and two check valves (24, 26) controls hydraulic oil flow. The first check valve (24), commonly referred to as an underfill valve, provides oil to the transfer chamber (14) when the chamber is under-filled. The second check valve (26), functions as an overfill valve, allows oil out of the transfer chamber when it is over-filled. During normal operation, there is often leakage past the piston that causes the transfer chamber (14) to be under-filled. An underfilled condition causes the diaphragm (12) to move farther back on the suction stroke and moves the spool (22) to uncover the underfill port (28) allowing oil to be drawn from the sump (20). This happens during the suction stroke of the pump (10), and the underfill valve (24) prevents oil from leaving the transfer chamber (14) during the pressure stroke.

In order for this system to operate, the pressure in the transfer chamber (14) must drop below atmospheric pressure. In a system where the inlet of the pump is not pressure fed, that normally happens during the entire suction stoke of the pump (10). However, if feed pressure is applied to the pump, the pressure in the transfer chamber can be above atmospheric pressure during the suction stroke and no oil is drawn in from the sump. The diaphragm will operate with a volume of oil that is insufficient to keep it from reaching the bottom of its travel limit. When this happens, the diaphragm stops moving while the piston continues its travel to BDC. During the period that the diaphragm stops moving, the pressure in the transfer chamber drops below atmospheric pressure and oil is drawn in. A portion of the pumps stroke is lost while this is occurring which causes rough running and loss of volumetric efficiency of the pump.

The object of this invention is to correct this condition when a feed pump is utilized and allow pressure sufficient to correct the underfill condition during the full suction stroke, so the diaphragm doesn't reach the end of its travel.

Figure 2:
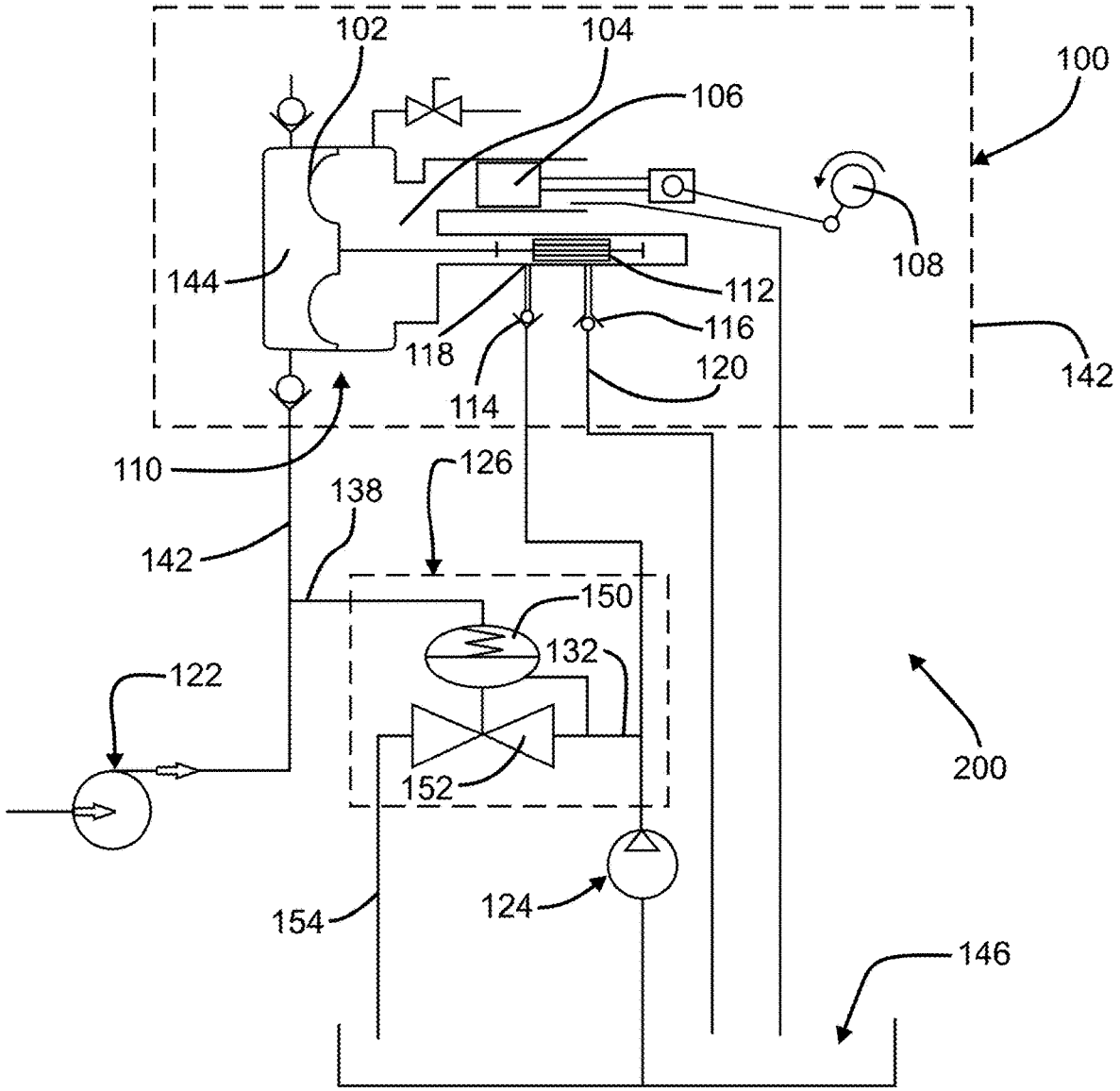
FIG. 2 is diagrammatic view of a hydraulically driven diaphragm pump with a feed pressure and auxiliary oil control system.
Figure 3:
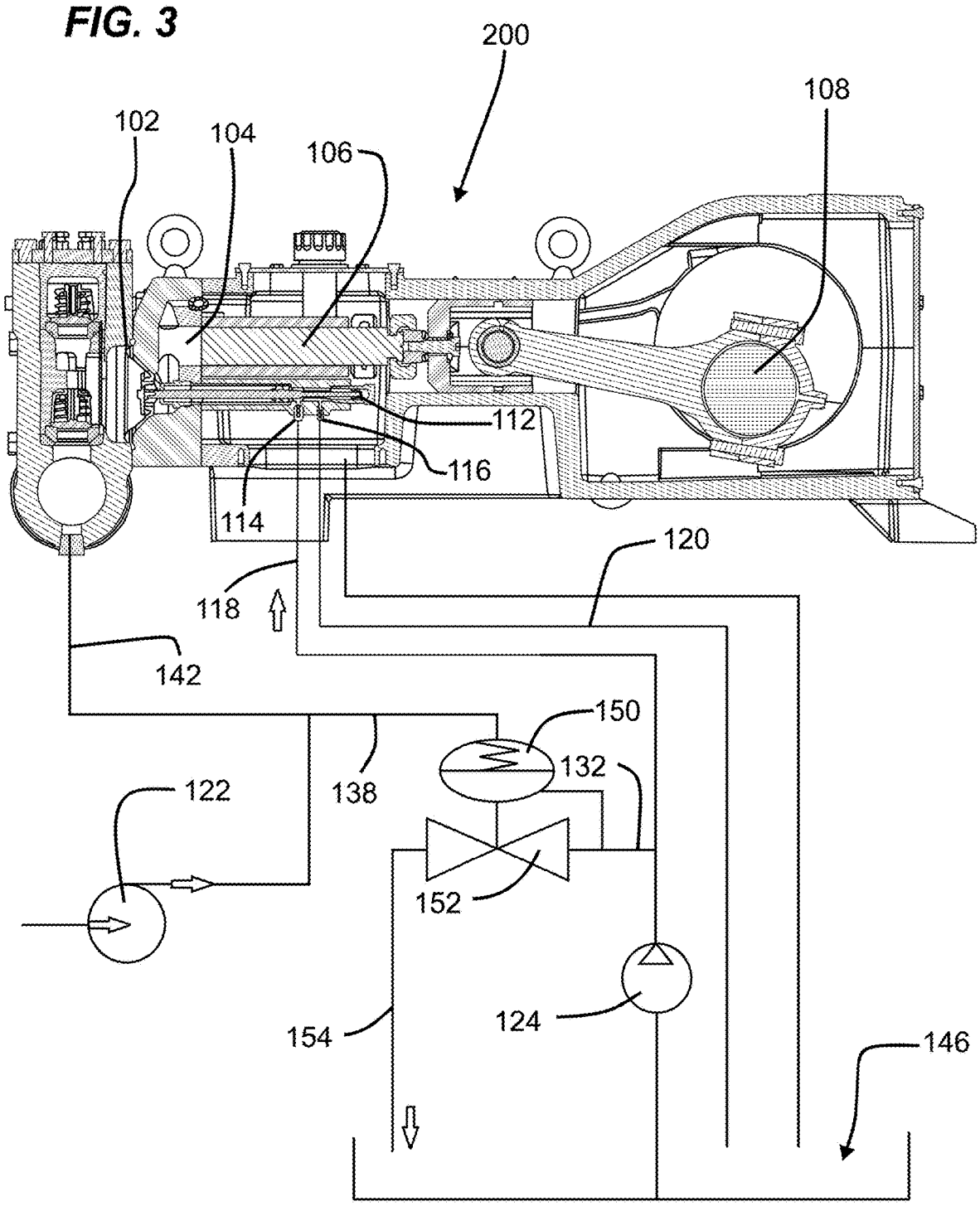
FIG. 3 is a side sectional view of a diaphragm pump and a diagrammatic view of the feed pressure and auxiliary oil control system
Figure 6:
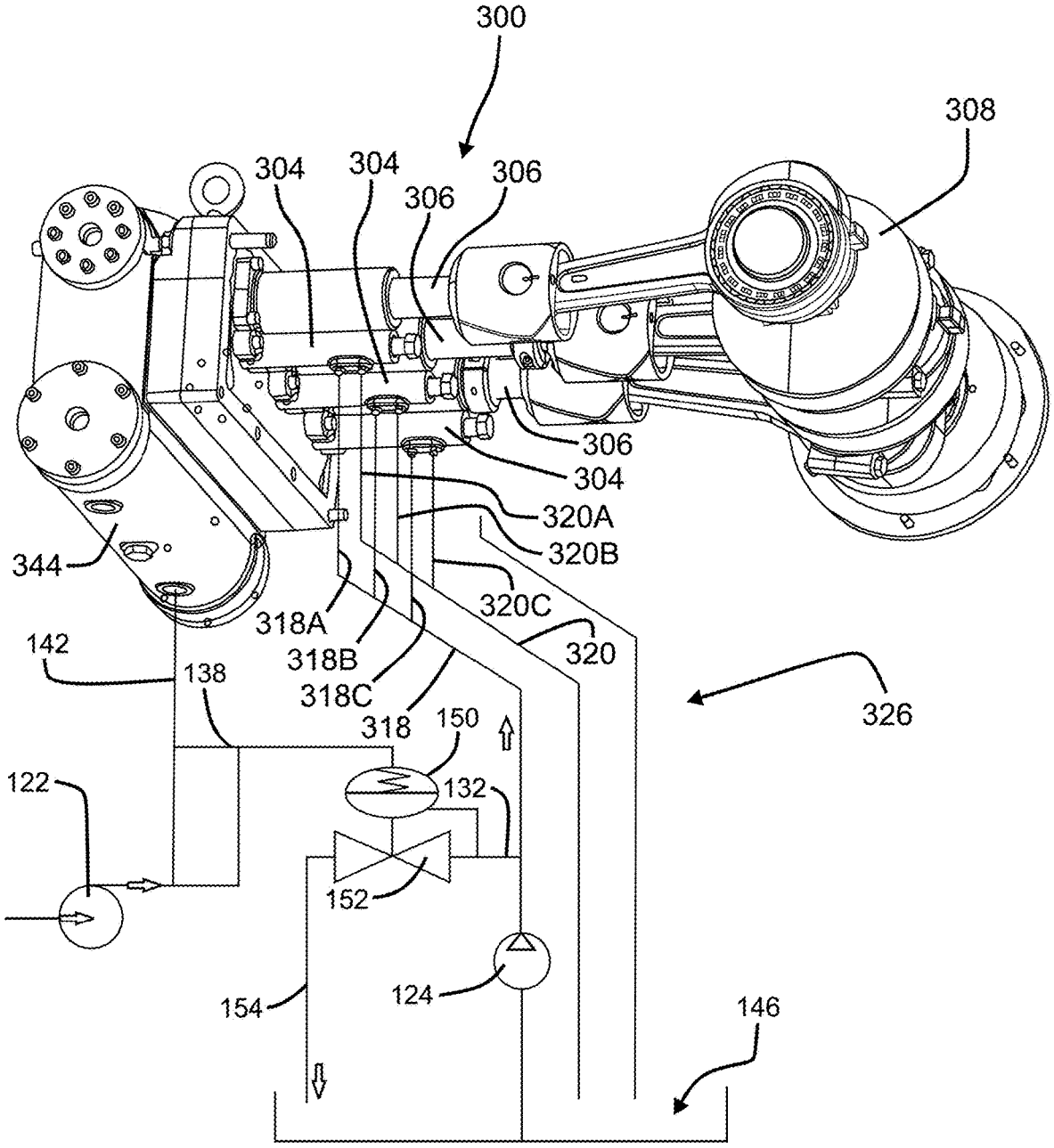
FIG. 6 is a perspective view of a pump manifold arrangement with multiple pistons and a diagrammatic view of a feed pressure and auxiliary oil control system.

Referring to FIG. 2 and FIG. 3, there is shown a pumping system (200) according to the present invention that utilizes three pumps and a control system with a diaphragm pump (100). The hydraulically driven diaphragm pump (100) is shown having a single cylinder, but the present invention is also applicable to a multiple-cylinder pump assembly (300), in which all cylinders are fed by a common connection to the oil pressure line, such as shown in FIG. 6, described hereinafter. The inlet of the diaphragm pump (100) is connected by line (142) to a feed pump (122), which provides boost pressure for the diaphragm pump (100). An oil pump (124) supplies the hydraulic fluid to the diaphragm pump (100). The pumped fluid is the fluid that both the feed pump (122) and diaphragm pump (100) are pumping. The oil pump (124) is a separate fluid system and supplies hydraulic fluid to the diaphragm pump (100).

In the system (200), a diaphragm (102) is driven by hydraulic fluid/oil in a transfer chamber (104). The diaphragm pump (100) has a housing (110) having a pumping chamber (144) containing fluid to be pumped, and the transfer chamber (104) adapted to contain hydraulic fluid. The hydraulic fluid is moved by a plunger or piston (106) that is driven by a crankshaft (108). That displacement of the piston (106) is transferred by the hydraulic fluid to cause displacement of the diaphragm (102). A supply of oil is contained in a sump (146) as a fluid reservoir, which is usually the crankcase of the pump (100), but may be a separate supply of oil than that used to lubricate the crankshaft bearings and other moving parts of the pump (100). The oil sump (146) is normally at atmospheric pressure. The pump (100) has a valve spool (112) and two check valves (114, 116) controlling hydraulic oil flow. The first check valve (114), commonly referred to as an underfill valve, provides oil to the transfer chamber (104) when the chamber is under-filled. The second check valve (116), functions as an overfill valve, allowing oil out of the transfer chamber (104) when it is over-filled. During normal operation, there may be leakage past the piston (106) that causes the transfer chamber (104) to be under-filled. An underfilled condition causes the diaphragm (102) to move farther back on the suction stroke and moves the spool (112) to uncover the port of underfill line (118) allowing oil to be drawn from the sump (146). This happens during the suction stroke of the pump (100), and the underfill valve (114) prevents oil from leaving the transfer chamber (104) during the pressure stroke. The overfill valve (116) when uncovered by the valve spool (112), allows excess oil to be drained from the transfer chamber (104) through outlet line (120) to the sump (146).

A pressure regulator assembly (126) controls the oil pressure to the diaphragm pump (100). Although there are alternate types of control valves that could be used, the simplest control includes a back pressure regulator that has an external pressure input, so that the pressure of the oil is maintained as a function of the feed pressure.

Figure 4:
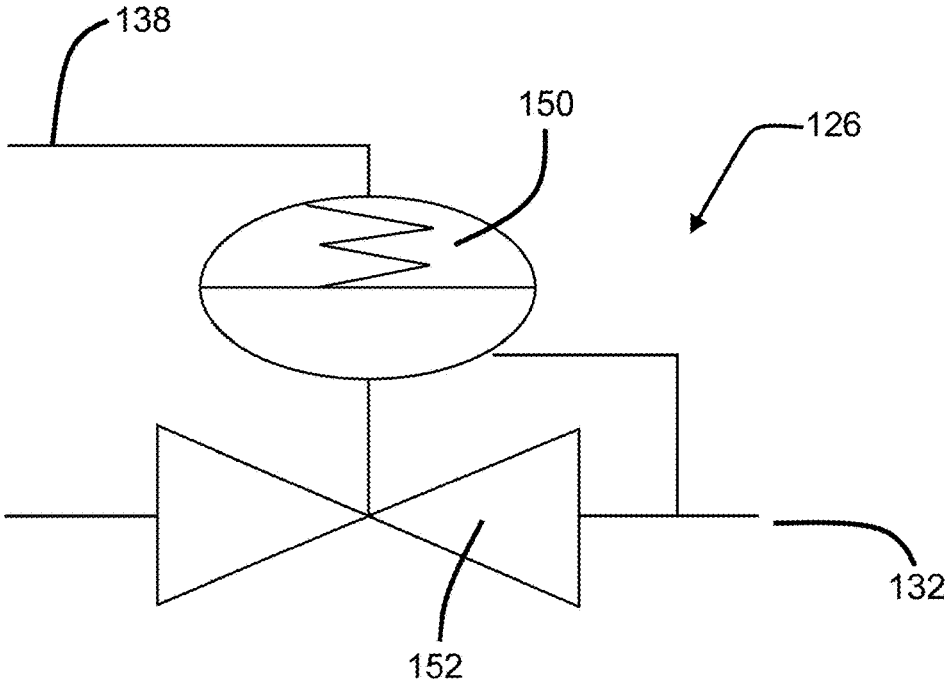
FIG. 4 is a diagrammatic view of the valve for the system shown in FIG. 2.

Referring to FIG. 4, there is shown details of the pressure regulator assembly (126) for the pumping system. The regulator assembly (126) acts as a controller and includes a combination of back pressure regulator (150), such as a spring loaded element that acts as a pressure sensor, and remote pressure control valve (152).

Figure 5:
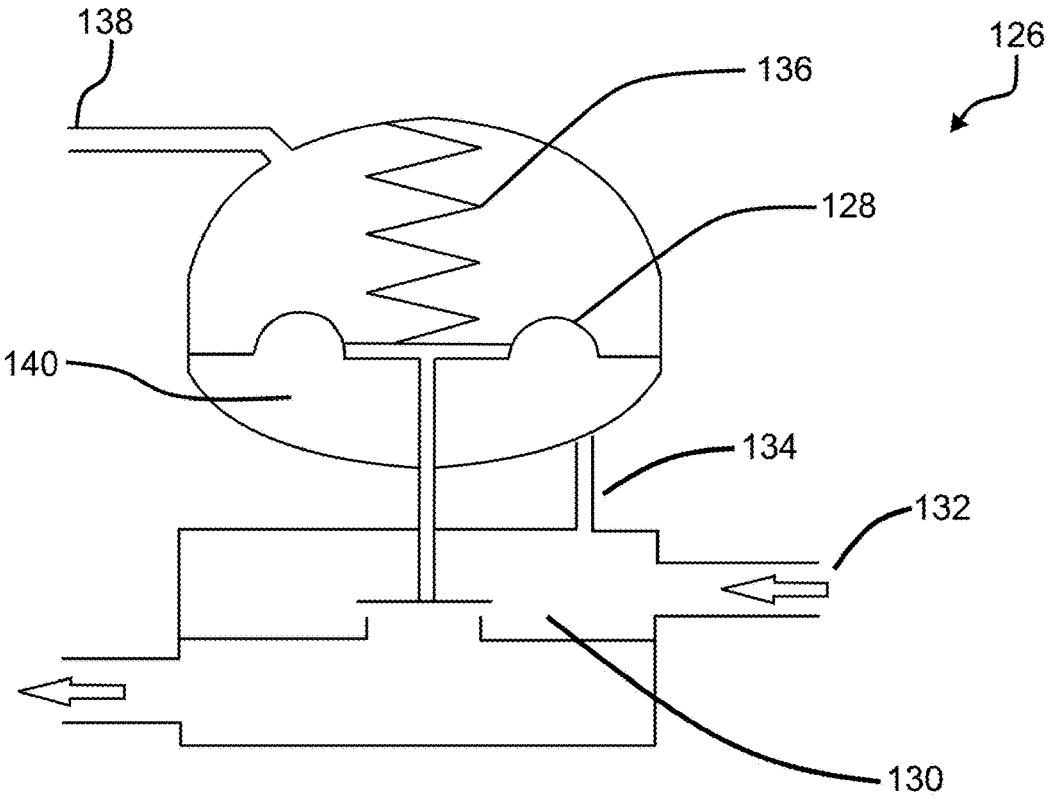
FIG. 5 is a diagrammatic view of an embodiment of a back pressure regulating valve with external differential pressure regulation.

Referring to FIG. 5, a schematic view of one embodiment of a valve assembly or pressure regulator (126) is shown. The regulator assembly (126) incorporates a diaphragm (128) that controls a valve assembly (130) providing proportional flow. Fluid entering the valve port (132) is on the controlled pressure side of the valve. On the opposite side of the valve (152) a drainage line (154) leads to the sump (146).

This is accomplished by a passage (134) that communicates the pressure to one side of the diaphragm (128). A spring (136) applies a force to the diaphragm (128) that opposes the pressure. Another port (138) is connected to the spring side of the diaphragm (128). This port (138) is connected to the feed pressure. The spring (136) is typically sized to apply a force to the diaphragm (128) that would require about 10-15 psi across the diaphragm to balance. The controlled pressure in valve port (132) and chamber (140) is therefore equal to the feed pressure plus 10-15 psi from the spring force. If the controlled pressure drops below the pressure above the diaphragm, the valve closes. This restricts the amount of oil from the oil pump (124), so pressure builds until the valve (130) opens a correct amount. A properly sized valve (130) will maintain the correct amount of opening, so the controlled pressure is maintained.

It has been seen that the diaphragm pump (100) will operate smoothly if the oil replenishment system provides oil pressure of about 10-15 psi above the pressure from the feed pump (122). Setting the oil pressure much more than 10-15 psi above the feed pressure could result in too much oil being added during the suction stroke causing the diaphragm position control to cycle between overfill and underfill. Since there can be many variables affecting feed pressure, it is not practical to have a fixed oil pressure. The system (200) is therefore applicable to a variety of pumps and applications.

Referring now to FIG. 6, an embodiment having a multiple-cylinder pump system (300) having a pressure regulator assembly (326) is shown. The multiple-cylinder pump system (300) and pressure regulator assembly (326) function in a similar manner as pump system (200) and pressure regulator assembly (326). In the embodiment of FIG. 6, the pump system (300) includes three pistons (306) driven by a single crankshaft (308). Each piston (306) has an associated transfer chamber (304) Each of the pistons (306) is associated with a corresponding diaphragm in a common manifold (344). The manifold receives pumping fluid through one line (142) from one feed pump (122). A single pressure regulator assembly (326) similar to the pressure regulator assembly shown in FIGS. 2 and 3. In the embodiment shown in FIG. 6, an underfill line (318) splits into three branches (318A, 318B, 318C) that connect to one of the transfer chambers (304). A single fluid outlet line (320) may include three branches (320A, 320B, 320C) that also connect to one of the transfer chambers (304).

Figure 7:
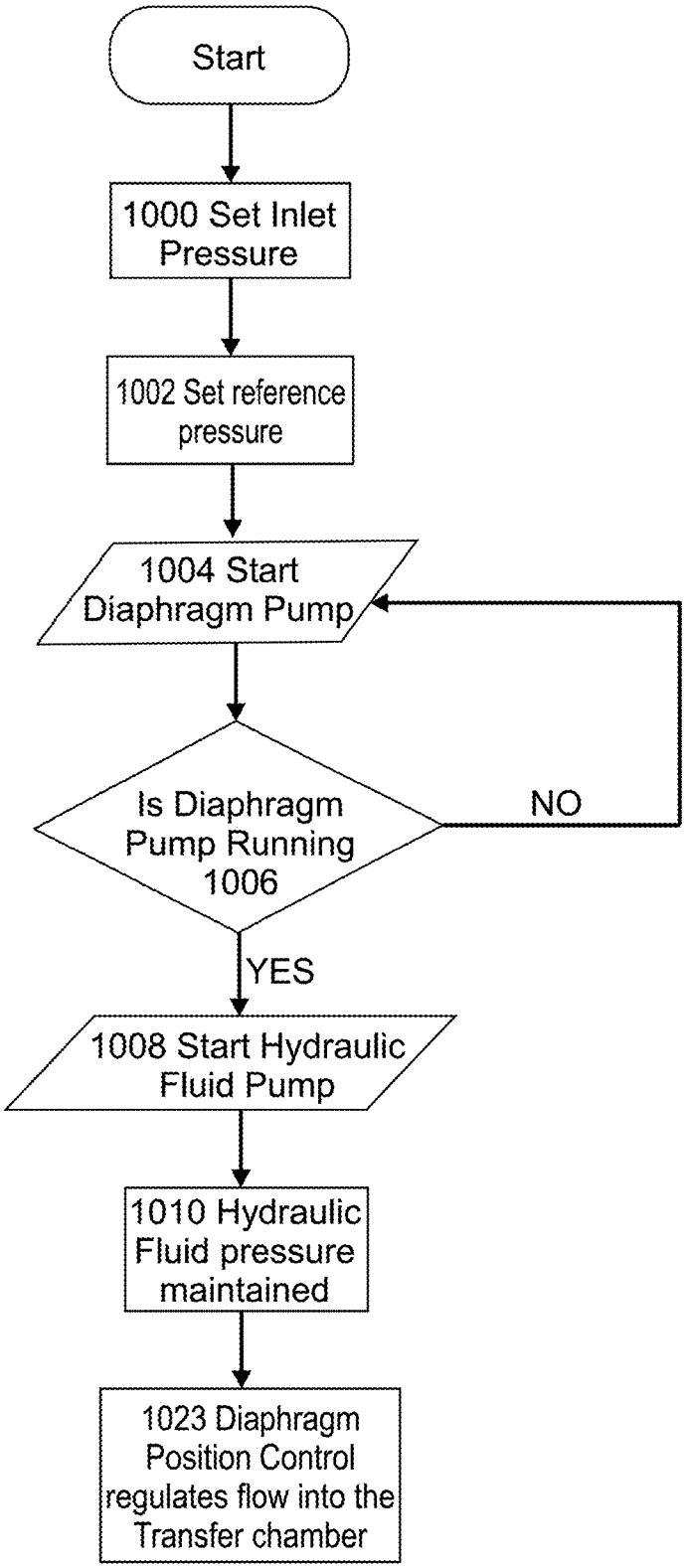
FIG. 7 is an operating diagram for the control system for the feed pressure and auxiliary control system shown in FIG. 2.

In operation, the diaphragm pump is set to operate with a pumped fluid inlet pressure at step (1000) of FIG. 7. The hydraulic fluid pressure regulator is set at step (1002) to a reference pressure from the inlet pressure. In normal operating conditions, the hydraulic fluid pressure is set above a pumped fluid inlet feed pressure, such as, for example, about 10 psi above a pumped fluid inlet feed pressure. When these pressure operating parameters are set the diaphragm pump is started at step (1004). Once the main diaphragm pump is running (1006) and these pressures have been set, the hydraulic fluid pump can be started at step (1008). The pressure regulator will maintain the hydraulic fluid pressure at the pressure level of the inlet pressure plus the reference pressure at step (1010). This pressure will be maintained at the inlet to the valves that control the flow of hydraulic fluid to the transfer chamber. The diaphragm pump's diaphragm position control valve will regulate flow of the hydraulic fluid into the transfer chamber at step (1012).

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of operating a diaphragm pump, the diaphragm pump comprising:

a housing having a pumping chamber containing fluid to be pumped, and a transfer chamber adapted to contain hydraulic fluid;

a diaphragm supported by the housing, the diaphragm defining a pumping chamber side and a transfer chamber side, the pumping chamber side at least partially defining the pumping chamber and the transfer chamber side at least partially defining the transfer chamber;

a driven plunger sliding in a reciprocating motion and forcing hydraulic fluid against the diaphragm;

a first valve allowing hydraulic fluid into the transfer chamber;

a second valve allowing hydraulic fluid to be removed from the transfer chamber;

a hydraulic fluid reservoir in fluid communication with the transfer chamber;

the method comprising:

operating the diaphragm pump at a pumped fluid inlet pressure;

setting a pressure regulator to controllably allow fluid to flow to the transfer chamber, the pressure regulator being actuated at a hydraulic pressure greater than the fluid inlet pressure of pumped fluid, wherein make-up hydraulic fluid flows to the transfer chamber when the pressure regulator is actuated;

setting pressures of the pressure regulator and starting the diaphragm pump, followed by starting an oil pump supplying the make-up hydraulic fluid.

2. The method according to claim 1, wherein a hydraulic fluid pressure is maintained at 10-15 psi above a pumped fluid inlet feed pressure.

3. A pumping system comprising:

a first pump comprising a diaphragm pump, the diaphragm pump comprising:

a housing having a pumping chamber containing fluid to be pumped, and a transfer chamber adapted to contain hydraulic fluid;

a diaphragm supported by the housing, the diaphragm defining a pumping chamber side and a transfer chamber side, the pumping chamber side at least partially defining the pumping chamber and the transfer chamber side at least partially defining the transfer chamber;

a driven plunger sliding in a reciprocating motion and forcing hydraulic fluid against the diaphragm;

a first valve allowing hydraulic fluid into the transfer chamber;

a second valve allowing hydraulic fluid to be removed from the transfer chamber;

a hydraulic fluid reservoir in fluid communication with the transfer chamber;

a second pump supplying fluid to the pumping chamber and creating a pumped fluid inlet feed pressure;

a third pump supplying make-up hydraulic fluid to the transfer chamber creating a hydraulic fluid pressure;

wherein the hydraulic fluid pressure is above the pumped fluid inlet feed pressure.

4. The pumping system according to claim 3, further comprising a back pressure regulator with a pressure input from the pumped fluid inlet feed pressure of the diaphragm pump.

5. The pumping system according to claim 4, wherein the back pressure regulator comprises a spring controlling a pressure control valve.

6. The pumping system according to claim 3, further comprising a controller, a pressure sensor, and a valve operated by the controller.

7. The pumping system according to claim 3, wherein the first valve comprises an underfill port to the transfer chamber in fluid communication with the first valve.

8. The pumping system according to claim 7, further comprising a valve spool slidably mounted in the transfer chamber and mounted to the diaphragm, the valve spool covering the first valve in a first position and uncovering the first valve in a second position.

9. The pumping system according to claim 3, further comprising a controller and a fluid pressure sensor.

10. The pumping system according to claim 3, wherein the hydraulic fluid pressure is 10-15 psi above a pumped fluid inlet feed pressure.

* * * * *